United States Patent [19]

Sato

[11] 4,112,998

[45] Sep. 12, 1978

[54] POURING METHOD AND APPARATUS THEREFOR

[75] Inventor: Jiro Sato, Nagoya, Japan

[73] Assignee: Fujiwa Kika Kabushiki Kaisha, Nagoya, Japan

[21] Appl. No.: 741,843

[22] Filed: Nov. 15, 1976

Related U.S. Application Data

[63] Continuation-in-part of Ser. No. 646,037, Jan. 2, 1976, abandoned.

[30] Foreign Application Priority Data

| | | | |
|---|---|---|---|
| Oct. 22, 1975 | [JP] | Japan | 50-126302 |
| Nov. 7, 1975 | [JP] | Japan | 50-150722[U] |
| May 10, 1976 | [JP] | Japan | 51-52152 |

[51] Int. Cl.[2] ..... B22D 37/00; B22D 41/04

[52] U.S. Cl. ..... 164/136; 164/4; 164/155; 164/335; 222/590; 222/604

[58] Field of Search ..... 164/133, 136, 150, 155, 164/281, 335, 4, 437, 438; 266/229, 230, 231, 236; 222/564, 590, 604, 605, 629

[56] References Cited

U.S. PATENT DOCUMENTS

| | | | |
|---|---|---|---|
| 1,143,215 | 6/1915 | Lummis | 164/136 X |
| 2,489,479 | 11/1949 | Cavallier | 222/590 X |
| 3,343,591 | 9/1967 | Lorang | 164/155 |
| 3,818,971 | 6/1974 | Schutz | 164/155 X |

FOREIGN PATENT DOCUMENTS

| | | | |
|---|---|---|---|
| 1,704 | 1/1971 | Japan | 164/155 |
| 223,273 | 10/1968 | U.S.S.R. | 164/136 |

*Primary Examiner*—Francis S. Husar
*Assistant Examiner*—Gus T. Hampilos
*Attorney, Agent, or Firm*—Neuman, Williams, Anderson & Olson

[57] ABSTRACT

A method and an apparatus for pouring molten metal from a ladle to a mold. The ladle is titled about an axis of rotation extending through a point proximate the outlet of the ladle, whereby the relative positions of the point where molten metal from the ladle begins to fall and the pouring cup of the mold are kept constant and the molten metal is poured into the mold without varying the path of the streamline between the ladle outlet and the pouring cup of the mold. The vertical sectional contour of the ladle including the outlet is segmental.

11 Claims, 19 Drawing Figures

POURING METHOD AND APPARATUS THEREFOR

The present application is a continuation-in-part of my U.S. Application Ser. No. 646,037 filed on Jan. 2, 1976, now abandoned.

BACKGROUND OF THE INVENTION

1. Field of the Invention

This invention relates to a method of casting iron, steel aluminum or the like and an apparatus therefor, and more specifically to such a method and apparatus for pouring molten metal from a ladle of special configuration and construction into a mold. The present invention is effectively applicable to a equipment for continuous casting iron, steel, aluminum or the like.

2. Description of the Prior Art

In the casting industry it is customary that the pouring of molten metal into molds depends on the knack of skilled operators long experienced in the art. Molten metal is carried in a ladle, usually of a generally cylindrical contour provided with an outlet on a top part, to a pouring section where a series of molds are arranged. Since the ladle usually is held by suspending means, the operator must rotate the ladle into the position where it pours molten metal into the pouring cup of the mold. At that point, the ladle outlet and the pouring cup of the mold are a certain distance apart, the distance being varied with further rotation of the ladle. In addition, the tilting of the ladle changes the surface area of molten metal in the vessel. If the ladle is tilted at a constant velocity, the volume of molten metal being poured will undergo gradual changes. The operator is, therefore, required to adjust both the position of the ladle outlet with respect to the pouring cup of the mold and the angle of ladle inclination while observing the curve of molten metal flow so as to compensate for the variations in the distance between the ladle outlet and the pouring cup of the mold and also in the amount of molten metal being poured. As noted above, these operations are very difficult and demand a high degree of technical skill. Moreover, the operations are extremely dangerous.

A common practice with the modern equipment for continuous casting of iron, steel, aluminum, etc. is to have molds as cope-drag combinations made, in succession, on a molding line, deliver the molds on a continuous mold conveyor line of the tact drive type, thereby moving the molds successively to a pouring section, tap a melting furance and fill the ladle with molten metal, and then a skilled operator tilts the ladle toward the pouring cup of each empty mold and pour the melt under control so that a suitable quantity of molten metal is supplied to the mold.

The foundry environment for these operations is very hazardous and poor with high temperature required and frequent splashing of the molten metal, such as iron or aluminum, against the surroundings. Further, as noted above, the pouring operation needs a high degree of skill and therefore well experienced workers.

For these reasons, there has long been a great need for an unattended, automatic pouring system. Attempts thus far made to meet this need include automatic pouring apparatuses of an electromagnetic induction conveyor type and of a valve type for hot pig iron. Both are of the so-called fixed-point type which operate stationarily while maintaining a large volume of metal in a melted state. Each mold is conveyed to a position exactly aligned to the outlet of the pouring apparatus and then the molten metal is poured into the mold. Therefore, a casting equipment must be installed to suit such an automatic pouring apparatus. While those automatic apparatuses are adapted for use with the new high-speed continuous casting installations of most modern designs, they cannot be readily incorporated into the existing casting plants. Also, the prior art automatic apparatuses are not suited for use with the casting equipment which does not employ the continuous mold conveyor system, or for pouring molten metal into molds arranged over a flat plane on a floor level, for example for forming large castings. Among other drawbacks of the conventional automatic apparatuses are very high cost of the electromagnetic induction conveyor type and frequent troubles with valves of the valve type for hot pig iron. Both require great skill and much expenses for the maintenance and inspection after routine operation. Once a trouble arises, they will need a long downtime. Nevertheless, because of the costliness of the apparatuses, it is practically impossible for founders to retain any stand-by unit.

SUMMARY OF THE INVENTION

The present invention is concerned with a method for pouring molten metal from a ladle into a mold and an apparatus therefor. The method comprises tilting the ladle in swinging movement about an axis of rotation extending through a point in the vicinity of the outlet of the ladle, thereby keeping the fall-starting point of the molten metal from the ladle and the pouring cup of the mold in constant relative positions, and pouring the molten metal from the ladle into the mold without varying the path of streamline between the ladle outlet and the pouring cup of the mold.

After numerous experiments it has now been found vital for safe, rapid and accurate pouring of molten metal into the mold that the velocity at which the molten metal is initially poured out of the ladle outlet should be kept constant.

From the very moment it begins to pour downward from the ladle outlet the molten metal must fall at the predetermined initial velocity. The end is attained in accordance with the pouring method of the invention by tilting the ladle in swinging movement at a considerably high velocity, say from 40 to 100 times as high as the ordinary pouring velocity to permit the tilting at the fixed initial velocity, and also by reducing the tilting velocity to the constant level instantaneously (within 0.5 second and usually between 0.2 and 0.5 second). When reducing the tilting velocity of the ladle in an instant it is important to do so continuously rather than through successive steps. If this high rate of velocity reduction is made stepwise, waving (undulation) will occur, making it no longer possible to provide a constant streamline of molten metal and achieve the end. To permit the instantaneous, continuous reduction of the tilting velocity to one-fourtieth to one-hundredth of the initial value in accordance with the invention, it has also been found desirable to employ a stepless speed changer, particularly a combination of a powder clutch and a powder brake both using magnetic powder. The magnetic powder clutch and brake are controllable with low power requirement (e.g., 24V-2A), and has an additional advantage of providing a compact and light-weight control circuitry.

Furthermore it has been found vital that the ladle for use specifically in safe, rapid and accurate pouring of molten metal into the mold according to the present invention is designed to have a construction such that a pouring outlet is formed in the front wall thereof, a guide bottom edge provided at the bottom of the pouring outlet to guide the molten metal from the outlet in a constantly uniform stream into the mold is arcuately shaped in vertical section, and the vertical sectional contour of the ladle as cut through the outlet is segmentally shaped to keep the exposed surface area of molten metal in the ladle substantially constant during the pouring operation, said front wall being formed, on the inner surface portion except for the pouring outlet, with an arcuate bulge centered around the center of arc of the arcuately shaped guide bottom edge, the axis of rotation of the ladle for tilting being an axis extended through the common center of arcs of the arcuate molten-metal guide bottom edge and of the arcuate bulge. In a preferred embodiment of the invention the ladle has weirs to avoid admission of slag into the mold.

The pouring apparatus of the invention is equipped with a self-driven vehicle adapted to run on rails so that the apparatus travels automatically for unattended pouring operation. A self-propelled pouring apparatus comprises a track laid to suit a casting line; a self-propelled carriage equipped with drives and controls and adapted to travel under control automatically along the track; a driven carriage separate from, and adapted to be driven by, the self-propelled carriage to run along the track; a chassis pivotally suspended from the self-propelled carriage and driven carriage via supporting pivots so as to couple the said two carriages; a ladle of a construction such that a pouring outlet is formed in the front thereof, a guide bottom edge provided at the bottom of the pouring outlet to guide the molten metal from the outlet in a constantly uniform stream into the mold is arcuately shaped in vertical section, and the vertical sectional contour of the ladle as cut through the outlet is segmentally shaped to keep the exposed surface area of molten metal in the ladle substantially constant during the pouring operation, said front wall being formed, on the inner surface portion except for the pouring outlet, with an arcuate bulge centered around the center of arc of the arcuately shaped guide bottom edge, the axis of rotation of the ladle for tilting being an axis extended through the common center of arcs of the arcuate molten-metal guide bottom edge and of the arcuate bulge; a hanger unit including means for supporting the ladle detachably as well as turnably about its axis of rotation and also including means for driving the ladle about its axis of rotation, said hanger unit being securd to the chassis through a hoist and a load weighing device for measuring the amount of molten metal in the ladle; guide means coactive with the hanger unit on the chassis to guide slidingly the hanger unit when the unit is moved upward or downward by the hoist; and control means for controlling the rate of pouring in response to measurement signals from the load weighing device.

As already noted, the ladle having the unique construction as mentioned above is most useful in carrying the present invention into practice. Theoretically the streamline of molten metal pouring out of such a segmental ladle should be constant provided the ladle is tilted at a constant pouring velocity. In some cases, however, the ladle will not rotate at the constant velocity or the flow rate of molten metal from the ladle may fluctuate while the ladle is being rotated at the constant velocity. Factors responsible for such irregularity may be a variation in the temperature, material, or viscous resistance of the molten metal, residual sludge in the ladle, variation in the load on the drive motor, or voltage fluctuation. Thus, controlling the ladle tilting velocity and the flow rate of molten metal at all times is another important consideration for automatic pouring operation.

It is therefore an object of the present invention, in view of the afore-described drawbacks of the conventional pouring methods and apparatuses, to provide a novel and useful pouring method and apparatus.

Another object of the invention is to provide a pouring method and apparatus for pouring molten metal from a ladle into a mold without changing the relative positions of the fallstarting point of molten metal from the ladle and the pouring cup of the mold that receives the molten metal.

Another object of the invention is to provide a pouring method and apparatus for making use of a ladle of novel construction so that the surface area of molten metal in the ladle will remain unchanged by the tilting of the ladle for pouring and that, when the ladle is tilted in swinging movement at a constant velocity, the pouring will be made possible at a constant rate always with the same streamline curve of the molten metal.

Another object of the invention is to provide an automatic pouring method using a ladle constructed so that its vertical section through the pouring outlet is segmentally shaped to make the exposed surface area of molten metal therein substantially constant particularly during the pouring period, the method comprising rotating the ladle about an axis extending through a point in the proximity of the outlet at a velocity $V_{\theta 1}$ to the pouring position, further rotating the ladle at a velocity $V_{\theta 2}$ ($V_{\theta 2} < V_{\theta 1}$) during pouring, and then reversely tilting the ladle at a given velocity upon conclusion of pouring, in such a manner that the pouring is carried out without substantially changing the streamline of molten metal falling from the ladle into the pouring cup of the mold, characterized in that the reduction from the velocity $V_{\theta 1}$ to the velocity $V_{\theta 2}$ is effected instantaneously and continuously.

Another object of the invention is to provide an automatic pouring method using a ladle constructed so that its vertical section through the pouring outlet is segmentally shaped to make the exposed surface area of molten metal therein substantially constant particularly during the pouring period, the method comprising rotating the ladle about an axis extending through a point in the proximity of the outlet at a velocity $V_{\theta 1}$ to the pouring position, further rotating the ladle at a velocity $V_{\theta 2}$ ($V_{\theta 2} < V_{\theta 1}$) during pouring, and then reversely tilting the ladle at a given velocity upon conclusion of pouring, in such a manner that the pouring is carried out without substantially changing the streamline of molten metal falling from the ladle into the pouring cup of the mold, characterized in that the tilting velocity $V_{\theta 2}$ is controlled to a predetermined rate.

Still another object of the invention is to provide an automatic pouring method using a ladle constructed so that its vertical section through the pouring outlet is segmentally shaped to make the exposed surface area of molten metal therein substantially constant particularly during the pouring period, the method comprising rotating the ladle about an axis extending through a point in the proximity of the outlet at a velocity $V_{\theta 1}$ to the pouring position, further rotating the ladle at a velocity $V_{\theta 2}$ ($V_{\theta 2} < V_{\theta 1}$) during pouring, and then reversely tilting the ladle at a given velocity upon conclusion of pouring, in such a manner that the pouring is carried out without substantially changing the streamline of molten metal falling from the ladle into the pouring cup of the mold, characterized in that the ladle tilting velocity $V_{\theta 2}$ is such that the rate at which molten metal is poured from the ladle is substantially constant during the pouring operation.

Still another object of the invention is to provide, in view of the disadvantages of the conventional automatic pouring apparatuses, a novel and useful self-propelled apparatus free of those disadvantages.

A further object of the invention is to provide a self-propelled pouring apparatus adapted for use effectively with whatever casting equipment, old or new, regardless of whether the mode of pouring is of the continuous mold conveyor type or the plane-arranged mold type.

A still further object of the invention is to provide a self-propelled pouring apparatus capable of conveying molten metal from a melting furnace to a given pouring section while, at the same time, performing the automatic pouring for which the apparatus is originally intended.

Still a further object of the invention is to provide a self-propelled pouring apparatus having simple construction and high reliability and capable of automatically travelling for the conveyance of molten metal and for automatic pouring.

An even further object of the invention is to provide a self-propelled pouring apparatus applicable to molds diversified in size.

Another object of the invention is to provide a ladle of a construction so that the surface area of molten metal in the ladle will remain unchanged by the tilting of the ladle for pouring and that, when the ladle is tilted in swinging movement at a constant velocity, the pouring will be made possible at a constant rate always with the same streamline curve of the molten metal.

An additional object of the invention is to provide a ladle adapted for casting operation without the help of any skilled labor.

Other objects and advantages of the invention will be evident from the following detailed description when read in conjunction with the accompanying drawings which illustrate the invention.

DETAILED DESCRIPTION OF THE INVENTION

Figure 1:
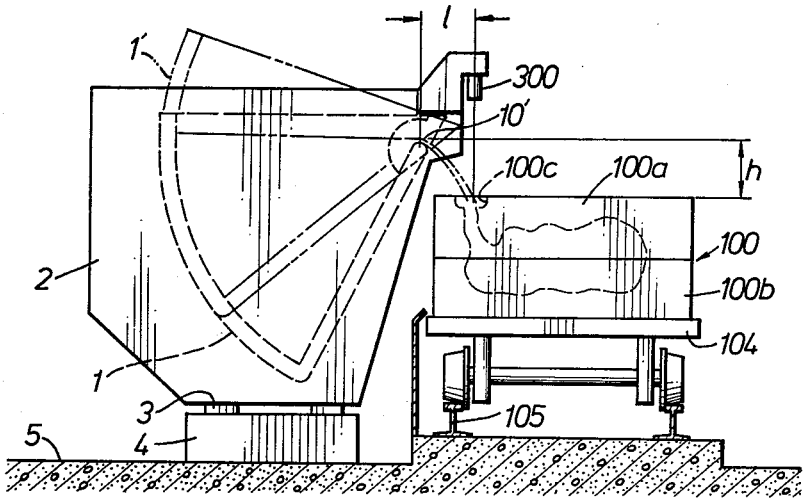
FIG. 1 is a schematic illustration of the relationship between a pouring apparatus embodying the invention and a mold during the pouring operation.
Figure 2:
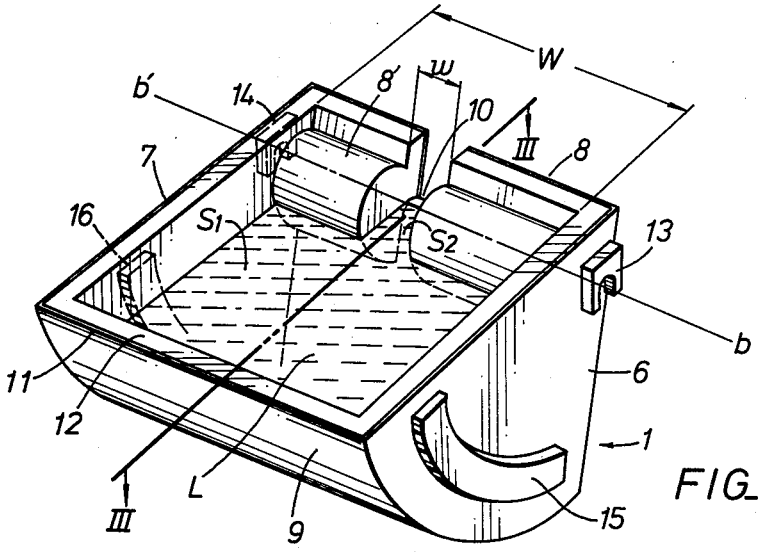
FIG. 2 is a perspective view of an embodiment of the ladle according to the invention.
Figure 3:
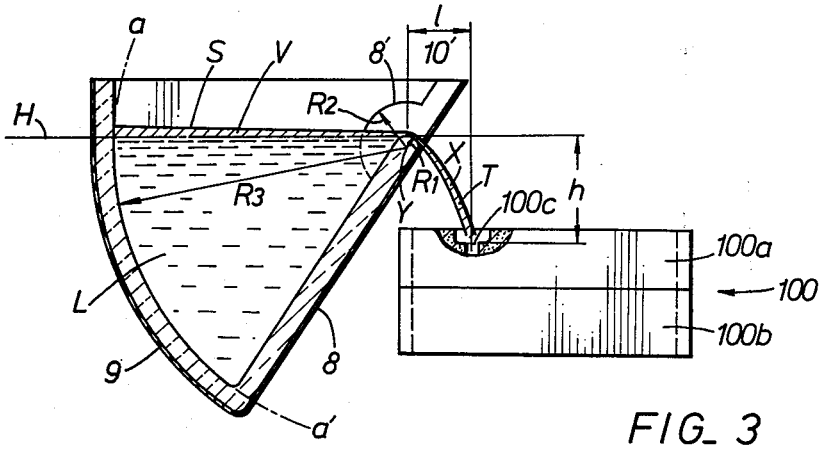
FIG. 3 is a vertical sectional view of the ladle taken along the line III—III of FIG. 2.

Referring to FIG. 1, there is illustrated a pouring apparatus embodying the invention, as comprising a ladle 1, a ladle holder 2 which accommodates the ladle, and a base 4 on the floor 5 for supporting the ladle holder. Beside the apparatus is shown a mold 100, which consists of a cope 100*a* having an inlet formed with a pouring cup 100*c*, and a drag 100*b*. The mold 100 is placed on and carried by a truck 104 on rails to the casting center where it is filled with molten metal by the pouring apparatus. In the casting center the ladle 1 of the apparatus is inclined in swinging movement to the pouring position 1', where it pours the molten metal from its outlet 10 toward the pouring cup 100*c* of the mold. Throughout the period of ladle filting or pouring operation, the point 10' of the mold outlet 10 where the molten metal begins to fall in a stream and the pouring cup 100*c* of the mold are kept in a constant relationship (1, h). Stated differently, as shown in FIGS. 2 and 3, the ladle is designed to rotate about an axis of rotation *b—b'* that extends through a point Y in the neighborhood of the ladle outlet lest the tilt of the ladle should bring any shift of the point 10' where the molten metal begins falling. This feature of the invention will be more fully described below.

With reference to FIGS. 2 and 3, the construction and operation of the ladle 1 will now be explained. The ladle 1 is of a construction such that, as it is tilted about the axis *b—b'* extending through the point Y in the proximity of the outlet 10 in the form of a channel with a width *w*, pouring molten metal L through the outlet into the mold 100, the exposed surface area S of the rest of molten metal L in the ladle will remain substantially constant and unchanged by the tilting of the ladle. An embodiment incorporating this feature of the invention is shown in FIGS. 2 and 3. The vertical sectional contour of the ladle 1 as cut through the outlet 10 is segmental as shown in FIG. 3, the contour being formed by a front wall 8 including the point Y on the axis of rotation *b—b'*, and a rear wall 9 connected integrally at the bottom to the front wall, with its inner wall surface drawing an arc *a—a'* of a radius $R_3$ with the center at the point Y. In addition, as FIG. 2 shows, both side walls 6, 7 extend in parallel a distance W apart and connect at right angles to the edges of the front and rear walls, thus providing the width of the generally segmental container. It is to be noted that the side walls are not limited to the configuration shown but may take any other shape provided they are symmetrically disposed with respect to the outlet. The front wall 8 has an inwardly protruding bulge 8' of a semiarcuate contour with a radius $R_2$ from the axis of rotation *b—b'* (at the reference point Y). This bulge 8' serves to keep the exposed surface area of molten metal in the ladle constant in the manner to be described later. The outlet 10 is a cut with a width w through the front wall 8 and the bulge 8'. The molten metal guide bottom edge provided at the bottom portion of the outlet 10 that forms the lower horizontal plane H of the imaginary flow of molten metal during pouring, is of an arcuate contour having a radius $R_1$ with respect to the point Y. This means that in the embodiment being described the thickness of the front wall is defined by $2R_1$. The ladle 1 consists of an inner wall or lining 12 of a refractory material and an iron-plate outer wall 11 of welded structure.

As the ladle 1 of the construction described is tilted around the axis of rotation *b—b'*, molten metal L will begin to pass through the outlet 10 of the front wall 8 and fall into the mold 100. A more careful study of this will reveal that, as shown in FIG. 3, the tilt of the ladle 1 raises the level of the molten metal above the lower horizontal plane H of the imaginary flow of molten metal by the amount of molten metal V to be thereby poured out, as hatched, and this balance of molten metal falls from the outlet along the arcuate molten metal guide bottom edge by gravity. Since the lower horizontal plane H of the imaginary flow of molten metal is higher than the axis of rotation *b—b'* by $R_1$ and the bottom, that is, the molten metal guide bottom edge, of the outlet 10 that forms the lower horizontal plane H is arcuately shaped with $R_1$, there is no possibility of the lower horizontal plane H being shifted by the tilting of the ladle. In other words, assuming that at the point 10' the molten metal V to be poured out begins to fall into the pouring cup 100*c*, the fall-starting point 10' will remain constant regardless of the tilted position of the ladle. Then it follows that only if the volume of the molten metal V to be flown out is kept constant, the pouring flow will always follow the same locus of molten metal streamline T. That is, pouring is accomplished while maintaining a constant relationship between the fall-starting point 10' and the pouring cup 100*c*.

Further, the construction of the ladle 1 in this embodiment of the invention enables the molten metal contained therein to have always the same exposed surface area S. As FIG. 2 shows, the exposed surface area S of molten metal consists of a large area $S_1$ occupying the open top surface of the vessel and a small area $S_2$ at the outlet, and because the latter is very small as compared with the former, a slight variation in the latter due to tilting of the ladle would be negligible. This combines with the constancy of the large area to maintain a practically unchanged exposed surface area S throughout the pouring period. Accordingly, the ladle 1 embodying the invention, when inclined in swinging movement at a constant rate, will pour the same volume of molten metal V, drawing the same streamline T throughout.

The invention has thus far been described as embodied in a ladle of special contour which keeps the exposed surface area of molten metal constant and which is tilted at a constant rate of rotation about an axis of rotation in the vicinity of the ladle outlet. However, as already noted, the present invention is characterized in that the fall-starting point where molten metal begins to overflow the ladle outlet is in a substantially constant relationship with the pouring cup of the mold therebelow throughout the pouring period. Thus, while the ladle contour, outlet structure, location of rotational axis, and constant rate of ladle rotation specifically described are most desirable for its embodiment, the present invention is not limited thereto but may be otherwise embodied. For example, the objects of the invention can generally be achieved even if the axis of rotation *b—b'* is slightly shifted from the abovementioned location. If a ladle of the type which by its rotation will change the exposed surface area of molten metal contained therein is used instead, steps may be taken to maintain a substantially constant relationship between the molten metal fall-starting point and the pouring cup of the mold and control the rate of ladle rotation lest the streamline of molten metal therefrom should vary. In this way the objects of the invention will again be realized.

Bearings 13, 14 are provided on the outer front ends of the ladle side walls 6, 7, respectively, in alignment with the axis of rotation *b—b'* that passes through the point Y, and they are disengageably engaged, respectively, with inwardly protruding pivots 21, 22 on the side walls of the ladle holder 2. Along the rear peripheries of the same side walls there are affixed racks 15, 16, in the form or arcs centering around the axis *b—b'*, and adapted to engage, respectively, ladle-driving pinions 23, 24 on the inner walls of the ladle holer 2.

Figure 4:
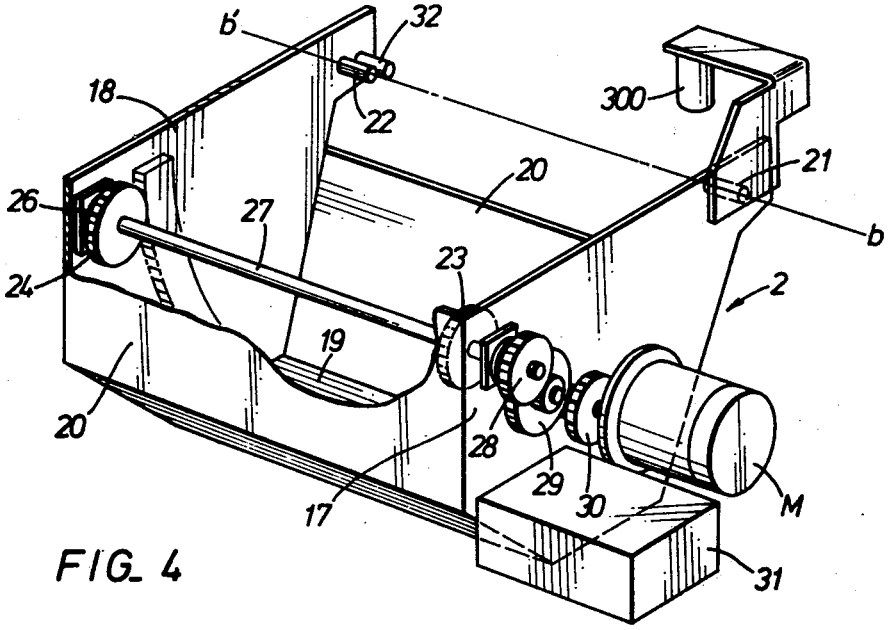
FIG. 4 is a perspective view of a ladle holder according to the invention.

The ladle holder 2 will now be described in detail in connection with FIG. 4. It is of a boxlike construction including side plates 17, 18, a bottom plate 19, and front and rear reinforcing plates 20, and is securely installed on the base 4. At the time of installation, as shown in FIG. 1, a load weighing device 3, such as a load cell, may be interposed between the ladle holder 2 and the base 4. The weighing device will transmit signals to controls 31 to be described later so as to control the rotation and stopping of the ladle and the volume of molten metal to be teemed out of the ladle.

Inwardly from the inner front ends of the side plates 17, 18 protrude pivots 21, 22 adapted to engage, respectively, the bearings 13, 14 of the ladle 1 and thereby to support the ladle pivotally. On the inner rear ends of those side plates, the pair of ladle-driving pinions 23, 24 adapted to engage the racks 15, 16 of the ladle are secured to a drive shaft 27, which in turn is rotatably journaled in bearings 25, 26 provided through the side plates. A drive gear 28, mounted on one exposed end of the drive shaft 27 that extends through the side plate 17, is driven by a motor M fast on the side plate 17 via a speed control mechanism 30 and a reduction gear 29.

Figure 15:
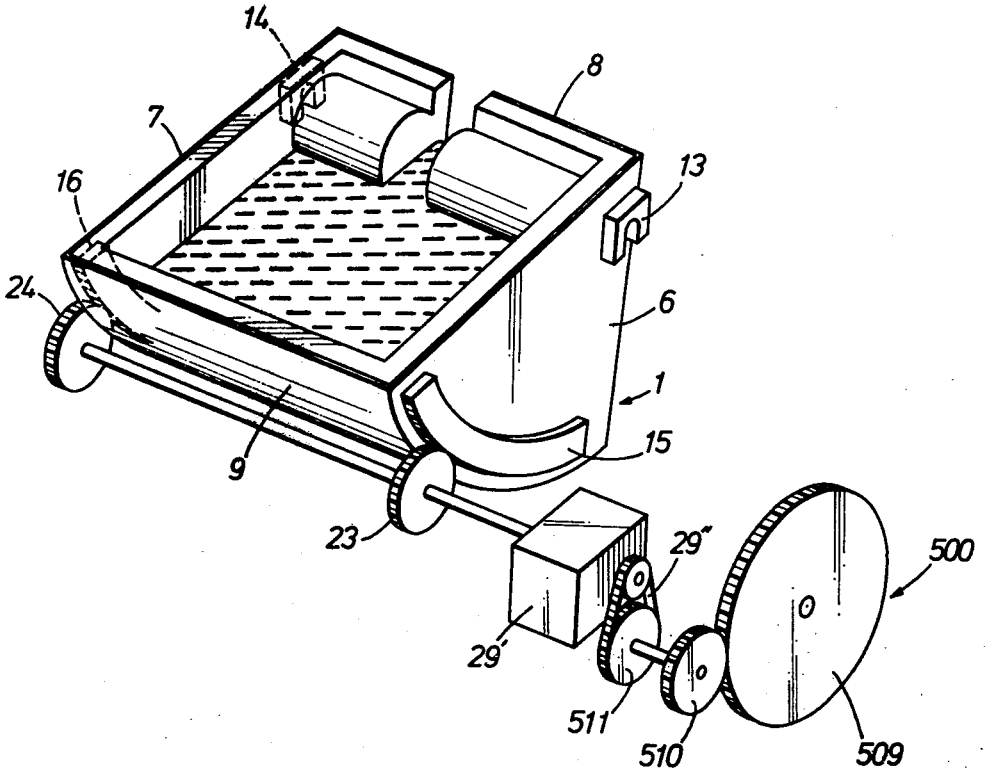
FIG. 15 is a perspective view of still another embodiment of the ladle drive for practicing the invention.

In another embodiment shown in FIG. 15, the ladle-driving pinions are connected to an output sprocket 511 of a rotational speed control mechanism 500 through a reduction gear box 29' and an endless chain 29''.

Figure 16:
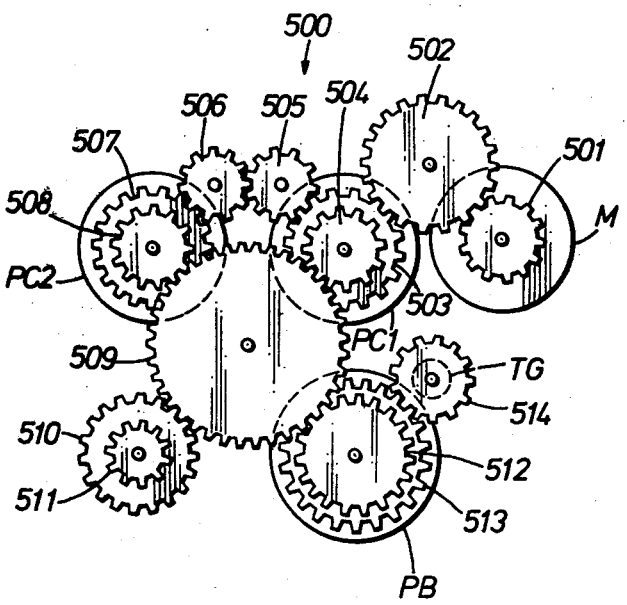
FIG. 16 is a schematic view of the rotational speed control mechanism of the ladle drive.

A form of the speed control mechanism 500 according to the invention is schematically illustrated in FIG. 16. Here the rotation of the ladle drive motor M is transmitted through a motor gear 501 and an idler gear 502 to the input gear 503 of a magnetic powder clutch PC1 for frontwardly tilting the ladle. Further, the rotation of the motor M is transmitted through idler gears 505, 506 to the input gear 507 of a magnetic powder clutch PC2 for rearwardly tilting the ladle. This means that the input gears 503 and 507 of the powder clutches PC1 and PC2 and hence the output gears 504 and 508, respectively, of these clutches run in opposite directions. Both the output gears 504 and 508 of the powder clutches are operatively connected through an idler gear 509 to an output gear 510 of the speed control mechanism. The rotation of the output gear 510, in turn, is transmitted via the output sprocket 511 and endless chain 29'' to the reduction gear box 29' and thence to the ladledriving pinions 23, 24. The idler gear 509 is connected to a magnetic powder brake PB through a powder brake gear 512, which is meshed with a gear 514 of a rotational speed detector TG. The frontwardly tilting powder clutch PG1 and the rearwardly tilting powder clutch PG2 are both capable of continuously controlling the power (rpm) being transmitted according to the quantity of electricity (voltage or current) applied to the control input terminal. Similarly, the powder brake PB functions to control the braking force continuously with the quantity of electricity supplied. As examples of such magnetic powder clutch and brake, Mitsubishi Electric Company's "POWDER CLUTCH MODEL ZE-A" and "POWDER BRAKE MODEL ZKB-A" (both trade names) may be mentioned.

While it has no far been described that the ladle is driven by means of the drive motor, speed control mechanism, gear train, and ladle-driving pinions, the power being transmitted in the order mentioned, the method of driving the ladle is, of course, not limited thereto; the gear type drives may be replaced, if desired, by any known means such as hydraulic (pneumatic) cylinders, hydraulic (pneumatic) speed control mechanism, and hydraulic (pneumatic) prime mover installed outside of the rear wall of the ladle.

As stated, controls 31 are installed on the side plate 17. On the front ends of the side plates 18, 17 there are located molten-metal detectors 32, 300, respectively, for the purposes to be described later.

The operation of the pouring apparatus embodying the invention will now be described. In its initial position indicated by broken lines in FIG. 1 the ladle 1 is held by the ladle holder 2, with its bearings 13, 14 engaged with the pinions 21, 22 of the ladle holder 2 and with the racks 15, 16 of the ladle meshed with the drive pinions 23, 24 of the ladle holder. Molten metal is transferred from a melting furnace (not shown) to the ladle in the state illustrated. Upon filling of the ladle with a predetermined amount of the molten metal, the load weighing device 2 generates a signal, in response to which the metal stream from the furnace is stopped. Molds 100 are carried one after another to the pouring section where the pouring apparatus is installed. The pouring cup of each mold brought to the filling position and the ladle held within the pouring apparatus are preset to the relative positions already described.

Next, referring to FIG. 3 and FIG. 15, the operation of the ladle 1 in accordance with the invention will be described. The ladle 1 is rotated and frontwardly tilted at the initial tilting velocity $V_{\theta 1}$ by the ladle drive motor M through the rotational speed control mechanism 500 and reduction gear box 29'. As the molten metal in the ladle 1 begins to flow out of the outlet to a point X (FIG. 3) of a falling streamline T past the fall-starting point 10', the molten-metal detector 300 provided on the front side of the ladle detects the outflow of the metal and causes the ladle 1 to slow down to a lower tilting velocity for pouring $V_{\theta 2}$ ($V_{\theta 2} < V_{\theta 1}$). The molten-metal detector is capable of detecting the outflow of the molten metal from the outlet 10 of the ladle by sensing, for example, the heat or light (visible, ultraviolet or infrared rays) emitted by the molten metal.

The amount of molten metal to be poured into each mold is predetermined, and the weight of molten metal in the ladle is weighed by the weighing device, or the load cell, prior to the initial tilting of the ladle. In the emobodiment being described, the pouring means 1 is installed on the base 4 via the load cell 3, and the molten metal in the ldle is weighed, actually in terms of the overall weight of the pouring apparatus. The weight thus measured is memorized by a measuring control unit (not shown), and then initial tilting of the ladle is started. The molten metal begins falling from the outlet of the mold, and the ladle is inclined at the tilting velocity for pouring $V_{\theta 2}$. The weight of the molten metal being poured out of the ladle is continuously measured by the load cell, and the measured value is compared with a desired value of pouring preset in the measuring control unit in a computing operation. At the point where the weight of the molten metal poured into the mold has become equal to the preset value, an output signal from the measuring control unit actuates the ladle drive controls 500 to tilt the ladle back at a high tilting-back velocity $V_{\theta 3}$. After having tilted back a predetermined distance the ladle stops and gets ready for the next pouring cycle. Preferably the tilting-back velocity is substantially equal to, or higher than, the tilting velocity for pouring $V_{\theta 2}$, or high enough to keep the molten metal away from the ladle wall as it falls downward from the ladle.

Figure 17:
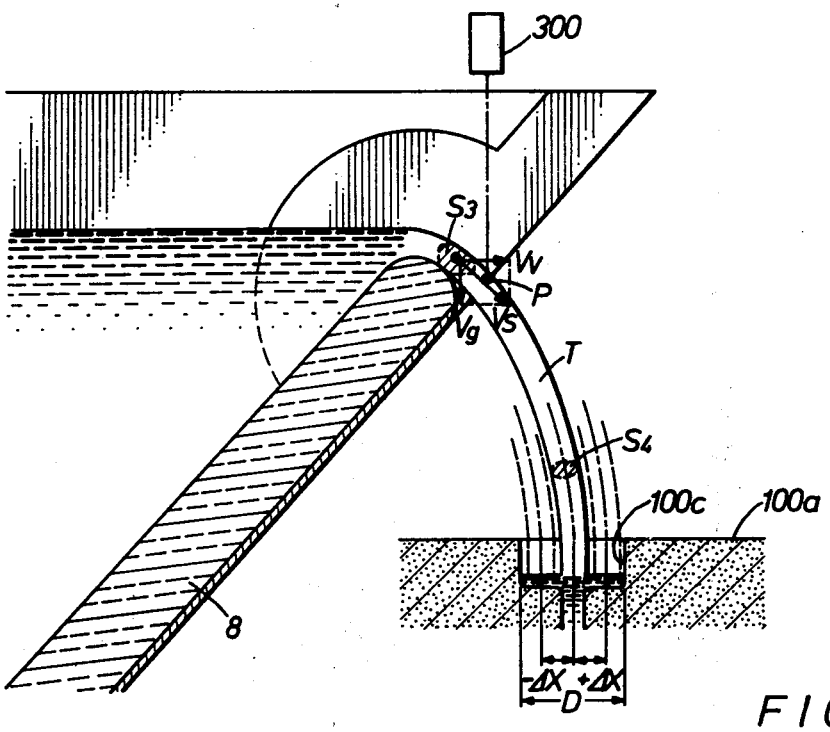
FIG. 17 is a partly sectioned detail view of the upper part of the ladle and the mold, illustrating the mode of pouring from the ladle into the pouring cup of the mold.

The operation for pouring molten metal from the ladle to the mold will be further described below in connection with FIG. 17. As stated, it is necessary that the flow velocity Vs of molten metal at the fall-starting point should be always substantially the same if the pouring streamline T of the molten metal is to be constant regardless of the tilting velocity of the ladle. The flow velocity of molten metal, which is obtained as the ladle is tilted at the constant pouring velocity $V_{\theta 2}$, must equally be attained when the ladle is initially tilted to the pouring position and the molten metal first flows out of the ladle outlet into the pouring cup of the mold. Should the ladle be tilted from the very beginning of rotation of the constant tilting velocity $V_{\theta 2}$, the molten metal would not pour down along the streamline leading to the pouring cup but would fall short of the line toward the mold portion immediately below the ladle outlet. In order to ensure the fall of molten metal from the outset direct into the pouring cup of the mold, the ladle must be tilted at a higher velocity than the constant tilting velocity $V_{\theta 2}$, or at the velocity $V_{\theta 1}$ which is 40 to 100 times as high as the velocity $V_{\theta 2}$ so that the molten metal is allowed to flow down initially at the velocity Vs. If the ladle tilting is kept on at the velocity $V_{\theta 1}$, the Vs will gradually increase to such an extent that the molten metal begins to flow down beyond the pouring cup with very undesirable consequences. For these reasons the velocity of the molten metal falling into the pouring cup of the mold must at all times be kept at Vs and therefore the tilting velocity must be promptly reduced to $V_{\theta 2}$. Thus, as noted before, the ladle tilting velocity is instantaneously reduced, as soon as the molten-metal detector 300 detects the start of pouring of the molten metal from the ladle outlet, from the initial tilting velocity $V_{\theta 1}$ to the constant pouring tilting velocity $V_{\theta 2}$. The use of the high initial pouring velocity, from 40 to 100 times as high as the subsequent constant tilting velocity for pouring enables the pouring molten metal to maintain a steady streamline with no possibility of the metal falling onto any other area than the pouring cup. The expression "instantaneous reduction of the pouring velocity" as used herein means that the pouring or tilting velocity is reduced from $V_{\theta 1}$ to $V_{\theta 2}$ in approximately 0.2 to 0.5 second.

Today, the continuous mold conveying line of the automatic casting line that adopts the automatic pouring system are often designed for high speed pouring at the rate of 15 to 30 seconds per mold, each time pouring 20 to 80 kg of molten metal into the cavity. Thus, there has been a strong need for the introduction of an automatic pouring method and apparatus that can fully meet the specifications. Now an embodiment of the pouring apparatus of the invention that can satisfy the foregoing conditions will be described.

| | | | |
|---|---|---|---|
| (1) | Molten metal | | : Cast iron |
| (2) | Pouring rate | | : 5 kg/second |
| (3) | Constant ladle tilting velocity for pouring $V_{\Theta 2}$ | | : 0.22°/min |
| (4) | Initial ladle tilting velocity | $V_{\Theta 1}$ | : 17.6°/min |
| (5) | Ladle dimensions | $R_1$ | : 30 mm |
| | | $R_2$ | : 100 mm |
| | | $R_3$ | : 700 mm |
| | | w | : 40 mm |
| | | W | : 700 mm |
| (6) | Positional relationship between molten metal fall-starting point and pouring cup of mold | | |
| | | l | : 160 mm |
| | | h | : 240 mm |

In this embodiment the streamline T is kept substantially constant by reducing the ladle tilting velocity from $V_{\theta 1}$ to $V_{\theta 2}$ in 0.3 second. Turning to FIG. 17, it is possible to limit the variation in the streamline of molten metal being poured within the area $\pm\Delta X = 15$ mm, and there is no possibility of the molten metal ($S_4 = \pi(10\ \text{mm})^2$) falling onto any other part than the pouring cup (D = 100–120 mm) of the mold.

The reduction of the ladle tilting velocity must be done, as stated above, by a stepless speed changer, particularly by a magnetic powder clutch and brake. Stepwise reduction, for example, by means of a clutch mechanism, changes in the number of poles of the drive motor, or by the use of master and slave motors is impractical because, as already pointed out, it will be impossible or next to impossible to tilt the ladle while maintaining $S_4$ or Vs constant.

Once the tilting velocity of the ladle has been reduced to $V_{\theta 2}$ the streamline of the falling molten metal will be constant as long as $V_{\theta 2}$ is constant. This is a phenomenon characteristic of the segmentally shaped ladle employed.

Actually, however, the temperature, material or viscous resistance of the molten metal, the sludge left in the ladle after continued use of the ladle, or the residual sludge around the ladle outlet often makes it difficult to maintain the pouring of molten metal from the ladle at a constant rate for a long period of time even though the ladle tilting velocity $V_{\theta 2}$ is kept constant. Where a motor or suchlike prime mover is used in driving the ladle, it is considered likely that, despite the use of the same prime mover, the ladle tilting velocity will vary accordingly as the load on the motor varies with the gradual change in the volume of molten metal remaining in the ladle. Similarly, where the ladle is electrically driven any fluctuation of the available voltage would vary the tilting velocity of the ladle and, where a hydraulic mechanism is employed instead for the same purpose, a change in the temperature of working fluid would result in an unsteady tilting velocity. For better automatic pouring, therefore, it is also essential to control either the pouring tilting velocity $V_{\theta 2}$ or the rate of molten metal flow to ensure constant pouring.

As regards the control of the pouring velocity, two methods are considered practical, i.e., (1) feedback control, and (2) control by measurement of molten metal weight, both of which will now be explained.

Figure 18:
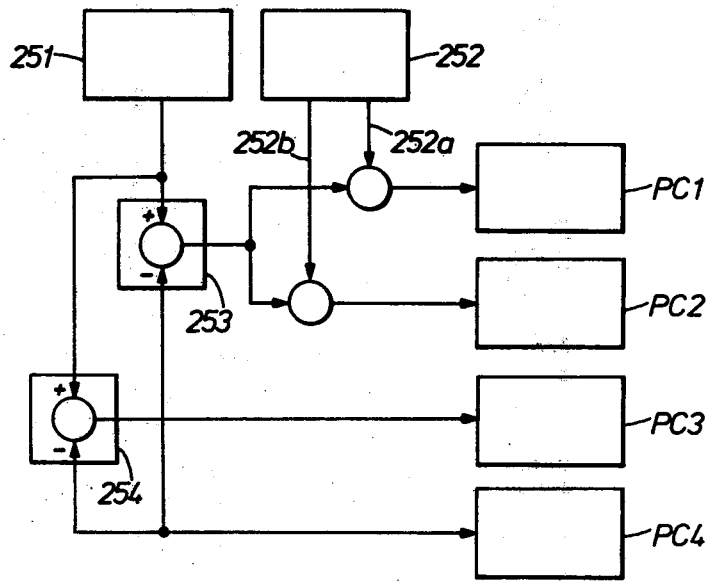
FIG. 18 is a block diagram of a pouring velocity control system for the ladle.

First, the feedback control will be discussed in conjunction with FIG. 18.

A velocity reference generator means 251 produces reference velocity signals corresponding to the initial tilting velocity $V_{\theta 1}$, pouring tilting velocity $V_{\theta 2}$, and rearwardly tilting velocity $V_{\theta 3}$. A tilting-direction signal generator means 252 generates signals for shifting the tilting direction of the ladle. For the durations of the initial tilting velocity $V_{\theta 1}$ and the ensuing tilting velocity $V_{\theta 2}$ for pouring, the signals appear in an output **252*a*, and during the rearwardly tilting velocity $V_{\theta 3}$ the signals appear in another output 252*b***. A velocity detector TG detects the actual tilting velocity of the ladle.

With the arrangement described the control system operates as follows. If the actual tilting velocity of the ladle is lower than the reference value, the velocity detector TG will give a velocity signal of a value smaller than the reference signal. In this case a comparator 253 generates a positive signal, and in response to it the tilting-direction signal generator means applies a corresponding signal to a preferred powder clutch (PC1 or PC2) for added driving power. Concurrently, another comparator 254 gives a negative signal to a powder brake PB for less braking force. In this manner the ladle tilting velocity is increased and controlled to a desired velocity.

Conversely when the tilting velocity is higher than the reference value, the comparator 253 will apply a negative signal to the powder clutch while, at the same time, the comparator 254 will apply a positive signal to the powder brake, thus decreasing and controlling the ladle velocity to the desired level.

To simplify the speed control mechanism the rearwardly tilting powder clutch PC2 may be omitted. With the simplified mechanism the ladle is frontwardly tilted in the same way as above described with the frontwardly tilting powder clutch PC1 and the powder brake PB, but in case of rearward tilting the braking input of the powder clutch PC1 is set to zero and the ladle is allowed to incline frontwardly by gravity, with the aid of braking by the powder brake. In this case, too, the feedback velocity control is accomplished with the powder brake.

Figure 19:
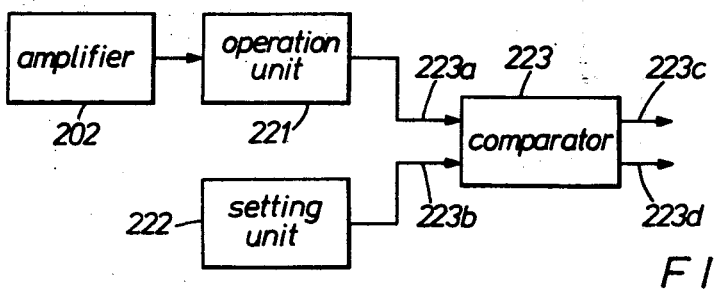
FIG. 19 is a block diagram of another pouring velocity control system for the ladle.

Next, the control that depends on weighing of molten metal will be considered with reference to FIG. 19.

This control method consists in computing the amount of variation per unit time of the measured value by a measuring instrument which continuously measures the weight, for example, of the ladle, or computing the amount of decrease in the weight of molten metal therein (i.e., the pouring velocity), comparing the computed value with a desired standard pouring velocity, and then decreasing the pouring tilting velocity of the ladle if the computed value exceeds the desired value or vice versa, thus maintaining a constant pouring rate.

The signal from a load cell (load-electricity converter) which weighs the ladle is input to a pouring velocity operation unit 221 through an amplifier 202. The output signal 223*a* from the pouring velocity operation unit 221 and the output signal 223*b* from a pouring velocity setting unit 222 are compared by a comparator 223, which then outputs a velocity-increasing signal 223*c* when 223*a* > 223*b* or a velocity-descreasing signal 223*d* when 223*a* < 223*b*. The signal for velocity decrease or increase is transmitted to the magnetic powder clutches and brake so as to control the tilting velocity of the ladle.

With the afore-described construction and function, the present invention permits safe, prompt and accurate pouring of molten metal from the ladle.

The ladle tilting velocities $V_{\theta 1}$, $V_{\theta 2}$ and $V_{\theta 3}$ referred to in the foregoing description may be set to optimum values in consideration of such variables as the capacity of the ladle, viscosity of the molten metal due to the kind of material and the temperature, and the relative positions (1, h) of the ladle outlet and the pouring cup of the mold.

Also, while the self-driven pouring apparatus of the invention has been described as equipped with a load cell for automatically controlling the amount of molten metal being poured from a ladle to a mold, the control of pouring may be accomplished by any other suitable control means or by incorporating said suitable control means in said load cell controlling system. An example will now be explained in conjunction with FIGS. 5 and 6.

As shown, the mold 100 is formed with a guide channel 100*e* in communication with the upper end of the pouring cup 100*c*. (Refer to FIGS. 5 and 6.) Molten metal L from the ladle 1 is admitted to the pouring cup 100*c*, collected therein temporarily, and then introduced into the mold cavity via a sprue 100*d*. The amount of molten metal poured (teemed for casting) from the ladle 1 is such that the molten metal level $s_1$ in the pouring cup is below the line *c—c*, or lower than the bottom surface $s_2$ of the guide channel 100*e* communicated with the pouring cup 100*c*. In other words, the flow of molten stream during normal casting is controlled so as to prevent any overflow of the molten metal from the pouring cup 100*c* into the guide channel 100*e*. The mold being filled up, the flow of the molten metal from the pouring cup 100*c* to the mold cavity via the sprue 100*d* is stopped and the molten metal collected in the pouring cup eventually overflows the line *c—c* to find its way into the guide channel 100*e*. In order to detect the overflow of molten metal into the guide channel 100*e*, a molten-metal detecter 300 is located above the guide channel 100*e* and perpendicularly to a part of the channel. Upon actuation of this detecter 300 the pouring of molten metal is stopped. Although in the present embodiment the molten-metal detector 300 is located immediately above a detection dish 100*f*, it is not a limitation to the invention but the detector may be provided in any other convenient location.

Figure 5:
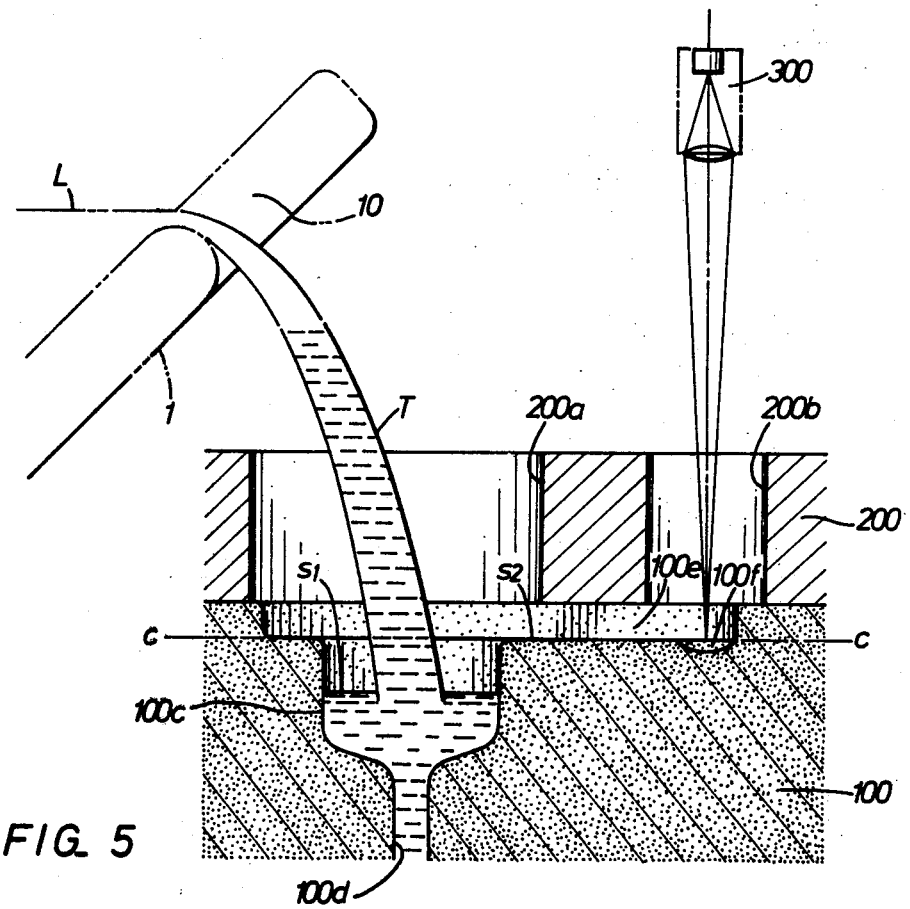
FIG. 5 is an enlarged detailed view of the upper part of the mold for illustrating into pouring method of the invention.
Figure 6:
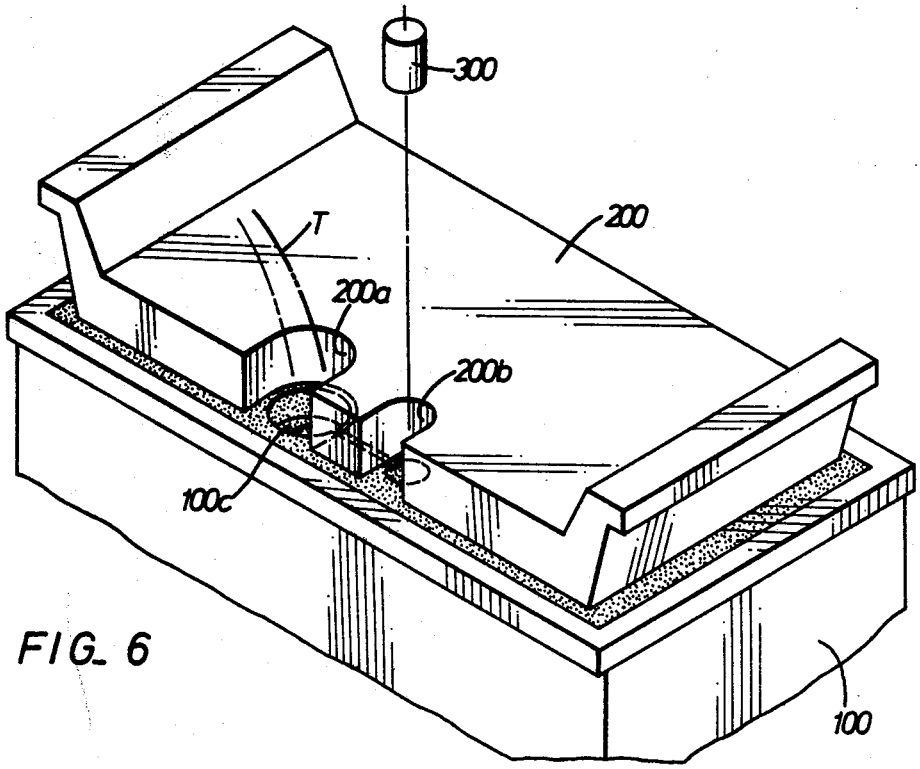
FIG. 6 is a perspective view of the upper part of the mold for illustrating the pouring method of the invention.

It can occur that, while being poured out of the ladle 1 into the mold, the molten metal impinges on, and splashes from, the pouring cup or the metal surface $S_1$ therein. The guide channel may be slightly elongated lest the molten-metal detector 300 should detect such splashing metal. Also, the splashing may be avoided by means of a shrounding recess 200*a* formed in a weight 200 over the cope (FIG. 5). When the procedure to be followed consists in detecting an overflow of molten metal from the pouring cup of the mold by means of the molten-metal detector and tilting the ladle back at a high velocity thereby stopping the molten stream, the spouring cup and guide channel of the mold must be designed to provide an adequate allowance for the reception of the portion of molten metal streamline between the ladle outlet and the mold.

With the pouring control system of the construction described, any defect that developed in the mold cavity would immediately cause an overflow of molten metal into the guide passage and have it detected for prompt stopping of the pouring. This is a feature not possessed by the ordinary pouring apparatus equipped with only a load cell. Such pouring control system may also be incorporated in an automatic pouring system of this invention which depends on a load cell for automatic weighing.

The ladle may be equipped with heat retaining means of a known design to avoid a temperature drop of the molten metal therein due, for example, to the suspension of supply of the mold to be filled up.

The ladle 1 to be used in the pouring method of the invention, with the apparatus for practicing the method, is not limited to the one illustrated in FIGS. 2 and 3, but may be variously embodied without departing from the spirit of the invention. Especially with an automatic pouring apparatus, the use of an improved ladle of a construction shown in FIGS. 7 and 8 which precludes the admission of slag to the mold will give a better result.

Figure 7:
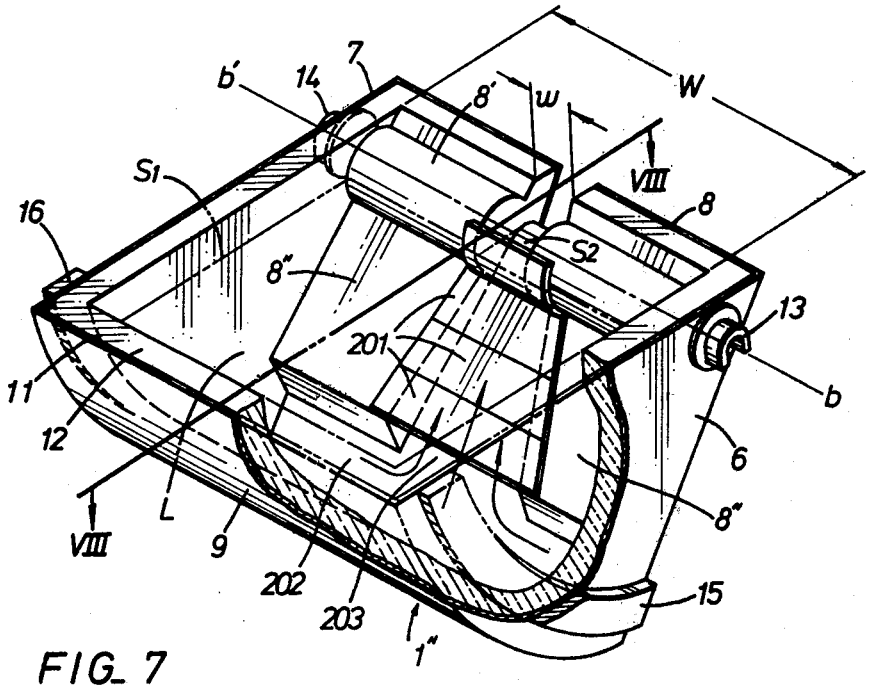
FIG. 7 is a perspective view of another embodiment of the ladle of the invention, with slag removed from the surface of molten metal therein.
Figure 8:
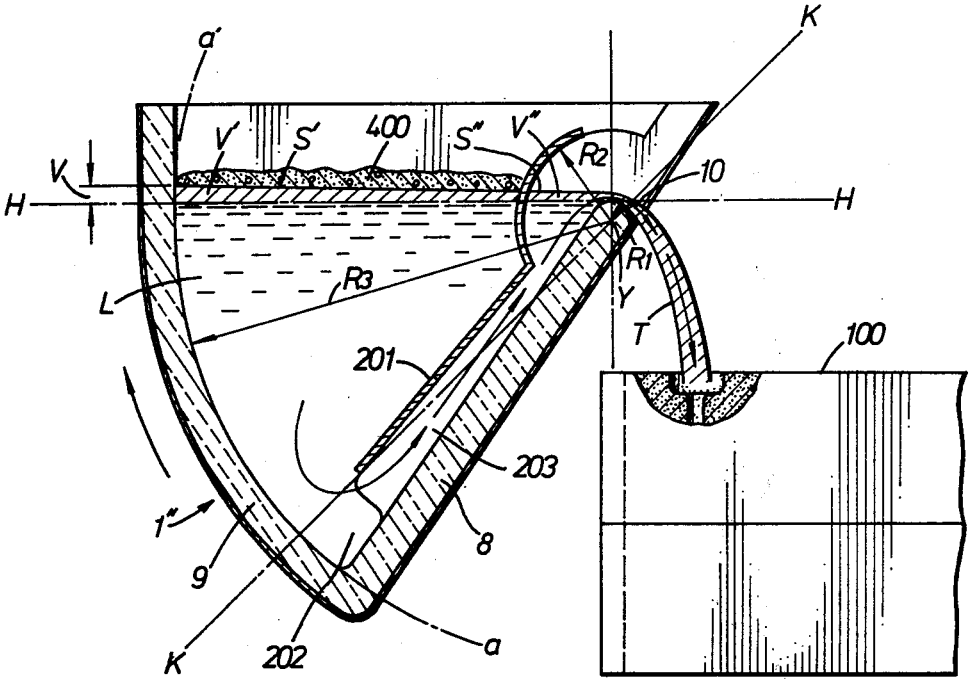
FIG. 8 is a vertical sectional view of the ladle taken along the line VIII—VIII of FIG. 7.

Now with reference to FIGS. 7 and 8, the preferred construction and function of the improved ladle 1'' will be described. Like the counterpart 1 shown in FIGS. 2 and 3, the ladle 1'' has such a contour that, when it is tilted in swinging movement about an axis *b—b'* that extends through a point Y in the vicinity of the outlet 10 in the form of a channel with a width *w* and molten metal L is thereby poured through the outlet 10 into a mold 100, the exposed surface area S ($S_1 + S_2$) of the molten metal L left in the ladle 1'' is kept substantially constant independently of the tilting of the vessel.

In addition, the improved ladle 1'' is formed with weirs 8'' adjacent the inwardly expanding bulge 8'. As shown in FIG. 7, the weirs 8'' extend along the inner surface of the front wall 8 toward the rear wall 9, forming a channel-like lateral guide passage 202 between the front wall 8, rear wall 9 and the weirs 8'' themselves. The weirs 8'' also define a channel-like vertical guide passage which extends from the outlet 10 along the front wall 8 toward the rear wall 9 and communicates with the lateral guide passage 202. The vertical guide passage is covered by a refractory partition wall members 201 to form a covered guide passage 203 for molten metal. The partition wall members 201 extend to overlap the weirs 8'' and the inward bulge 8' of the front wall. Consequently, the molten-metal guide passage 203 is communicated at one end with the ladle outlet 10 and at the other end with the lateral guide passage 202 near the rear wall 9. Although the guide passage 203 is shown in FIG. 7 as spreading gradually from the outlet 10 along the front wall 8 toward the rear wall 9, this is not a limitation to the invention; it may take any other convenient shape for the flow of molten metal therethrough.

Figure 9:
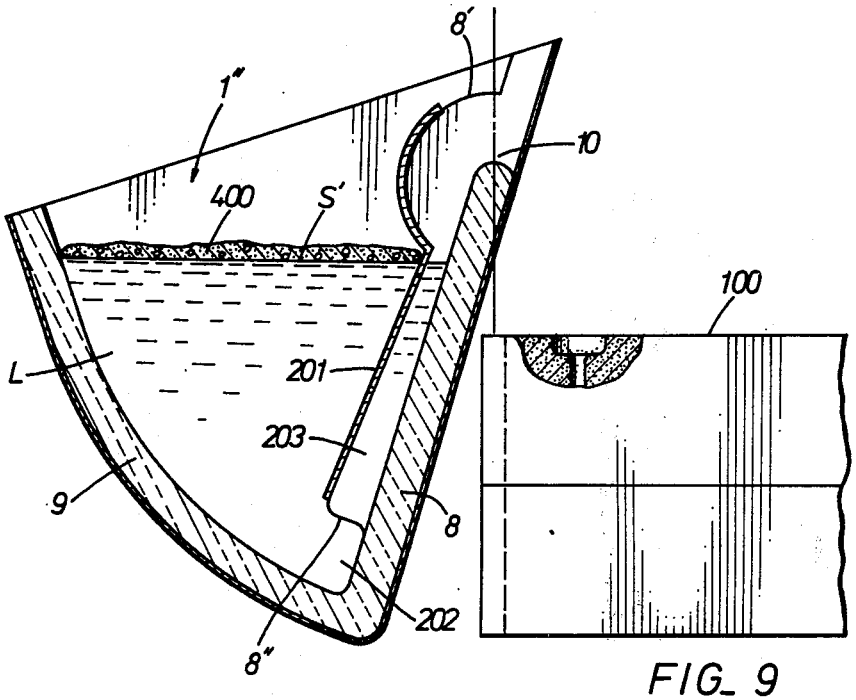
FIG. 9 is a view similar to FIG. 8 but showing the ladle prior to pouring.

The ladle 1" is held by a ladle holder 2 in the initial position as illustrated in FIG. 9, with its bearings 13, 14 engaged with the corresponding pivots of the ladle holder and with its racks 15, 16 in mesh with drive gears of the holder. In the state shown, molten metal is transferred from a melting furnace (not shown) into the ladle. The molten metal is filled in the ladle 1" but slag 400 is obstructed by the partition wall members 201 and is nonexistent on the surface S" of molten metal in the guide passage 203 or is negligible, if any. It follows that all or nearly all of the slag remains on the surface S' of molten metal on the opposite side of the partition wall members 201 in the ladle 1".

Next, the ladle 1" is tilted in swinging movement about the axis of rotation *b—b'*, when the molten metal L begins to flow through the outlet 10 formed in the front wall 8 into the mold 100. Upon careful observation of the state at this moment it will be obvious to those skilled in the art that, as illustrated in FIG. 8, the rotation of the ladle 1" into the pouring position will leave the molten metal behind on a level higher than an imaginary horizontal plane H under the molten metal to be flown out, by the overall volume to be poured V (V' + V") as indicated with hatching. The excess of the molten metal thus left behind is poured by gravity out of the outlet. Since the molten metal L in the ladle 1" is divided into two portions by the partition wall members 201, the surface portion V' of the molten metal on the left side of the partition wall members 201 as viewed in FIG. 8 is kept from directly flowing toward the outlet 10, but the lower portion of the molten metal is admitted through the lateral guide passage 202, the vertical guide passage 203, and finally through the outlet 10 into the mold. The slag floating over the molten metal surface is kept by the partition wall members 201 from finding its way toward the outlet 10, and therefore is prevented from entering the mold.

With the tilting of the ladle in the embodiment described, the molten metal L in the ladle 1" is introduced into the mold via the guide passage 203 and the outlet 10. In the meantime, the slag 200 floating over the molten metal surface is left behind throughout the pouring cycle. At the point where the remaining molten metal in the ladle has decreased to a level below the line K—K', the pouring operation is stopped. To continue the pouring after the molten metal level has dropped below the line K—K' is possible but undesirable because of the danger of slag intrusion into the mold. In fact, the residual molten metal below the line K—K' is often less than a moldful and therefore cannot be poured at all.

The pouring of molten metal from a ladle of the construction and functions above described precludes, to a great practical advantage, the possibility of any ingress of slag into the mold. Moreover, the pouring operation with the improved ladle of the invention brings castings of stabilized quality because the surface portion of molten metal subject to chemical changes due to contact with the air is not flown out but always the lower portion of the molten metal is selectively released. With this improved ladle there is no necessity of removing the floating slag from the surface of molten metal. On the contrary, the slag is intentionally allowed to be present over the molten metal surface to avoid the chemical changes of the surface due to exposure to the air and prevent a temperature drop of the molten metal. The weirs 8" and partition wall members 201 in the improved ladle, which have rather short life in the service at elevated temperature, can be most easily maintained and replaced where necessary since they are simply placed on the inner side of the front wall of the vessel.

The present invention has thus far been described as embodied in a stationary pouring apparatus. However, the invention is not limited thereto but is applicable as well to a self-propelled pouring apparatus adapted for use advantageously with a continuous casting installation.

Figure 10:
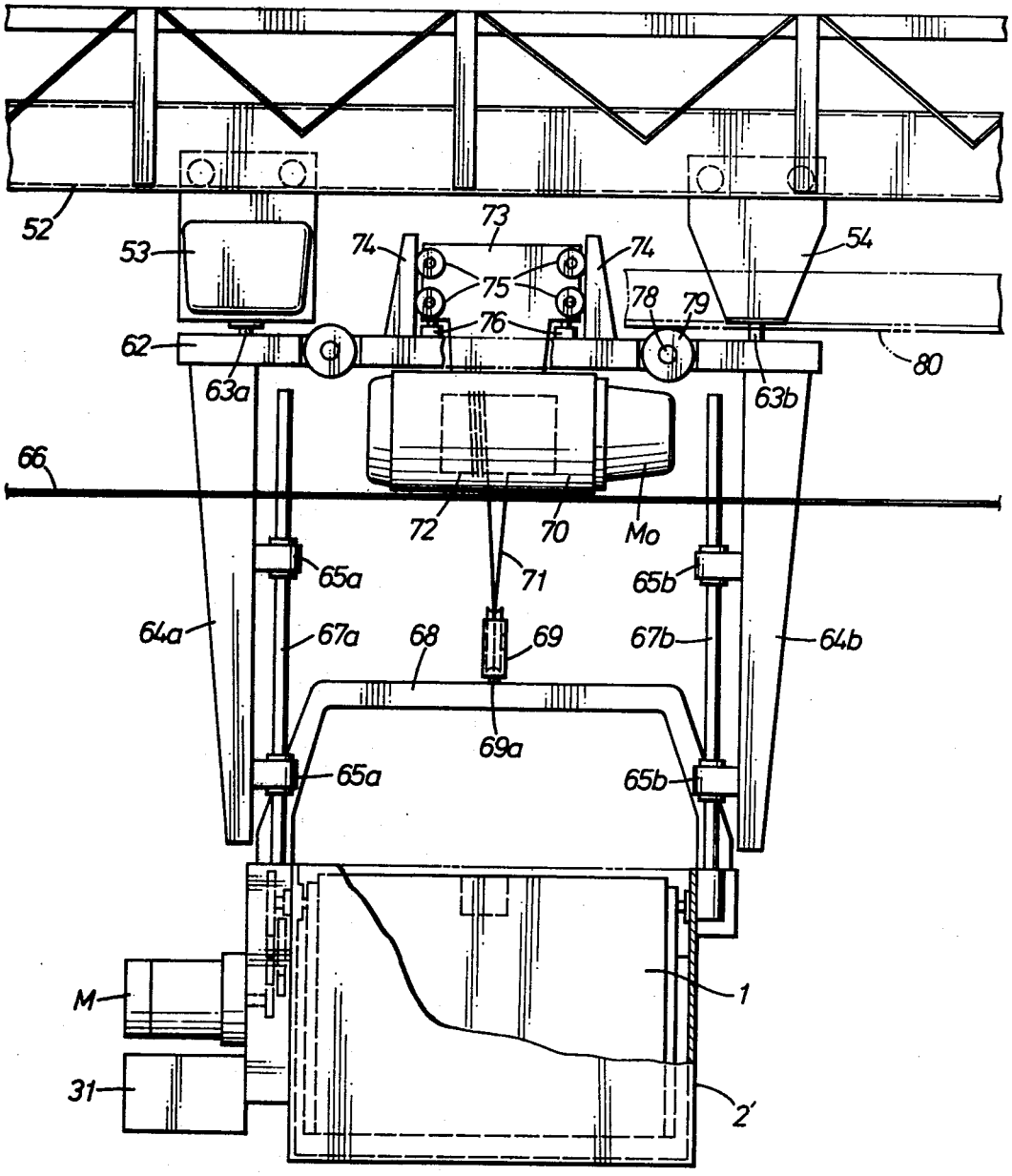
FIG. 10 is a front view of an embodiment of the self-propelled pouring apparatus of the invention.
Figure 11:
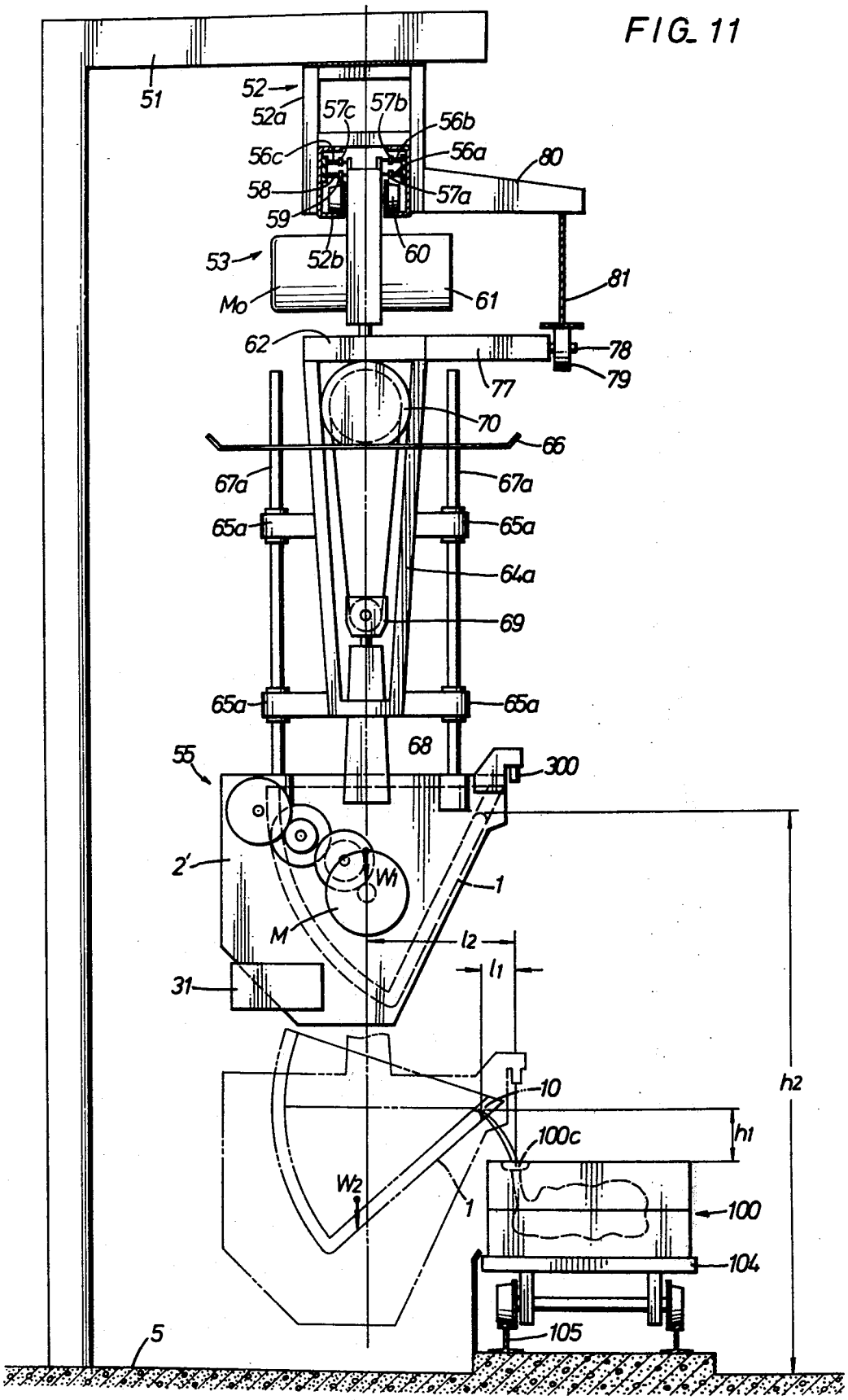
FIG. 11 is a side view of the self-propelled pouring apparatus shown in FIG. 10, illustrating the relationship between the apparatus and a mold and the mode of pouring.

A self-propelled pouring apparatus according to the invention, as illustrated in FIGS. 10 and 11, comprises a track 52 secured to a horizontal arm of a post 51 standing on a floor 5, a drive carriage 53 suspended from the track 52 to travel automatically therealong, a driven carriage 54 arranged in tandem with the drive carriage 53, a ladle holder 2' suspended by the drive carriage 53 and driven carriage 54, and a ladle 1 carried by the ladle holder 2'. The ladle 1 may be the same as the one shown in FIG. 2 or 7. The ladle holder 2' is substantially the same as that in FIG. 4 but is partly modified to suit the self-propelled pouring arrangement, as will be described later. In the following description the assembly of the ladle 1 and the ladle holder 2' will be collectively referred to as a pouring unit 55.

The track 52, as shown in FIG. 11, comprises rails 52*b* and frames 52*a* having sufficient strength to support the drive carriage 53 and pouring unit 55. In addition, it includes power rails 56*a*, 56*b*, 56*c* for supplying electric power to the drive carriage 53 and the pouring unit 55, and a control rail 58 for the transmission of control signals between the drive carriage 53 and the pouring unit 55, on one hand, and controls on the ground, on the other hand, the said rails being insulated from one another and securely attached to the rails 52*b*.

The drive carriage 53 comprises wheels 60 engaged with the rails 52*b* for travelling along the track 52, current collecting shoes 57*a*, 57*b*, 57*c* in sliding contact, respectively, with the power rails 56*a*, 56*b*, 56*c* on the track 52 for the reception of power supply from the latter, a control current collecting shoe 59 in sliding contact with the control rail 58 on the track 52 for the reception of control signals from the latter, a motor Mo for driving the wheels 60, and a controller 61 for receiving signals from the control current collecting shoe 59 and controlling the drive carriage 53 and the pouring unit 55.

The pouring unit 55 includes a chassis 62 which is suspended from the drive carriage 53 and the driven carriage 54 via pivots 63*a*, 63*b*, respectively. This arrangement enables the drive carriage 53 and the driven carriage 54 to move pivotally with respect to the chassis 62 and carry the pouring unit 55 curvedly along the track 52 when such a curved travel is required. At the both longitudinal ends of the chassis 62, hanger arms 64*a*, 64*b* extend downwardly. On the inner opposing sides of the hanger arms 64*a*, 64*b* are provided slide bearings 65*a*, 65*b*, which in turn slidably support guide shafts 67*a*, 67*b* anchored at the lower ends to the ladle holder 2'.

The ladle holder 2' is moved upward and downward by the concerted motion of a hoist 70, a hoisting rope 71, and a block 69 pivotally connected via a pivot 69*a* to a hanger 68 provided integrally with the ladle holder 2'. The sliding guide shafts 67*a*, 67*b* and slide bearings 65*a*, 65*b* guide the ladle holder 2' in its vertical movement. The hoist 70 is rigidly supported by a carriage 73 to which guide rolls 75 are pivotally secured in rolling engagement with the inner opposing sides of guide rails 74 formed integrally with the chassis 62. Thus, the hoist 70 is made movable upward and downward along the guide rails 74. The hoist 70, or the carriage 73, is suspended on the chassis 62 via a load weighing device 76, such as a load cell, attached to the chassis 62. This means that the ladle holder 2' and therefore the ladle 1 and the molten metal L therein, too, are suspended by the chassis 62. The values measured by the load weighing device 76 are transmitted to an operating unit in the control box 31 affixed to one side of the ladle holder 2' so that the load or the quantity of molten metal can be controlled.

In one piece with the chassis 62 may be formed chassis arms 77, at the free ends of which rollers 79 are rotatably supported by axles 78, so that the rollers 79 can roll along a support rail 81 secured to truck arms 80 extending at right angles from the track 52. The support rail 81 with which the rollers 79 engage may be provided only in the region of the track 52 corresponding to the pouring section, so that, when the ladle 1 is tilted for pouring with the rollers 79 engaged with the support rail 81 in the pouring section, the center of gravity will shift from $W_1$ to $W_2$ which is off the central axis of the pouring unit, thus hampering the turning effort for rotating the whole structure of the pouring unit about the track 52. (Refer to FIG. 11.) As shown in FIGS. 10 and 11, a heat shielding plate 66 is provided above the ladle holder 2' and beneath the chassis 62. It serves to protect the drive carriage 53 and the controls against the heat of molten metal when the ladle 1 is filled up.

Figure 12:
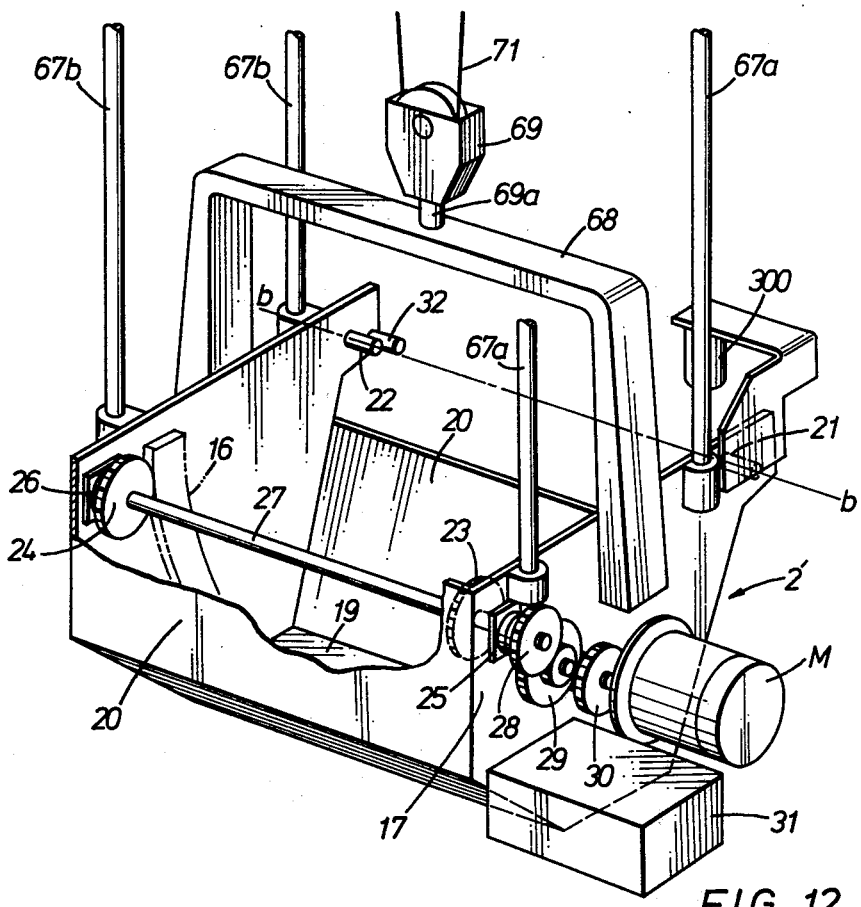
FIG. 12 is a perspective view of a ladle holder for holding the ladle of the self-propelled pouring apparatus according to the invention.

As already noted, the ladle 1 and the ladle holder 2' which jointly constitute the pouring unit 55 are the same as the ladle 1 or 1'' and the holder 2' described earlier in conjunction with FIG. 2 or 7. The only difference lies in the fact that, as shown better in FIG. 12, the ladle holder 2' in the embodiment being described is connected on its side plates 17, 18 with the sliding guide shafts *67a, 67b* and the both arms of the inverted-U-shaped hanger 68, whereby the ladle holder is suspended from the drive carriage 53. As a consequence, the pouring unit 55 is operated in the same manner as stated with reference to FIGS. 2 to 4.

A further embodiment of the invention will be explained below with regard to a continuous casting equipment incorporating the self-propelled pouring apparatus of the invention.

Figure 13:
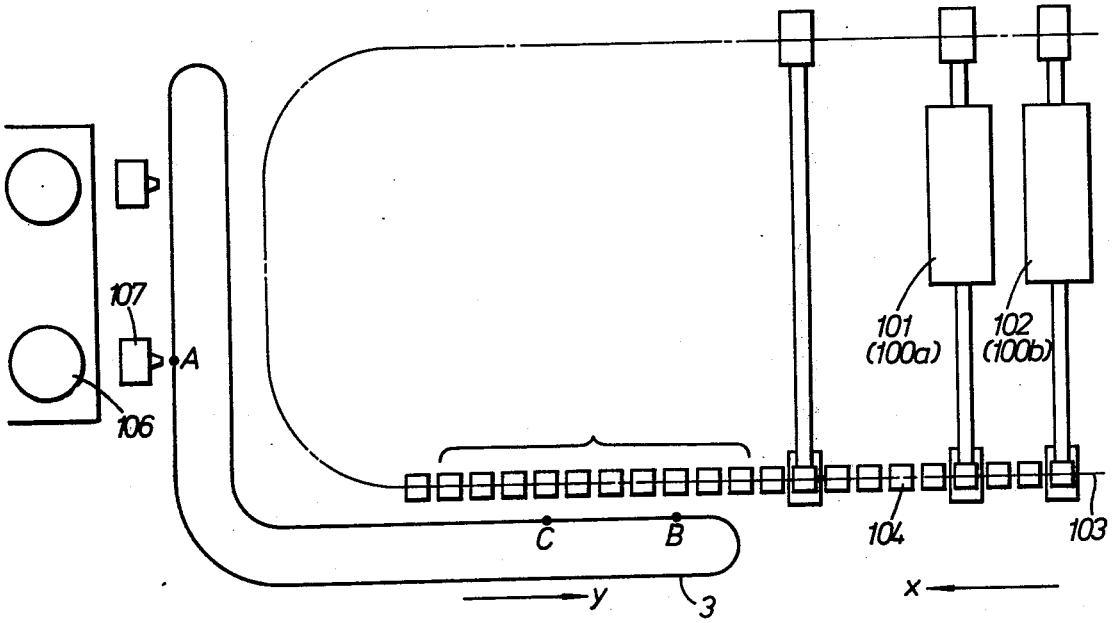
FIG. 13 is a schematic plan view of an exemplary continuous casting equipment incorporating the self-propelled pouring apparatuses of the invention.

Molds 100 are made, in sucession, separately as copes *100a* and drags *100b* by molding machines 101 and 102. The top and bottom parts of the molds are combined and set in place on trucks 104 over a mold conveyor line 103 which in turn is intermittently driven by a tact system at a predetermined pitch in the direction of an arrow *x*. The molds in a row are conveyed toward a pouring section 105, where a track 52 is provided for the movement and actuation of the pouring unit 55 for pouring molten metal into the molds. The track 52 is arranged to form a closed loop and the pouring unit 55 is allowed to trace the path of closed loop in one way, e.g., in the direction of an arrow *y* in FIG. 13. This self-propelled pouring apparatus is designed to cooperate not only with the mold conveyor line but also with induction furnaces (metal melting furnaces) 106 and holding furnaces 107 to fill the ladle 1 of the pouring unit 55 with the molten metal. A plurality of such automatic pouring apparatuses may be suspended from the track 52 so as to run in the direction of an arrow *y* within the closed loop.

First, each drive carriage 53 of such an automatic pouring apparatus within the closed loop of the track 52 stops at a point A in front of a holding furnace 107, and molten metal L is transferred from the holding furnace 107 into the ladle 1 of the pouring unit 55. Upon transfer of a predetermined amount of molten metal into the ladle 1, the load weighing device 76 associated with the chassis 62 generates a signal with which to stop further transfer of the molten metal. Usually the drive carriage 53 travels by itself after a post-treatment (e.g., the addition of magnesium) of the molten metal L in the ladle 1 to a point B in the pouring section, where the carriage stops in such a way that a certain relationship ($l_1$, $h_1$) is established between the pouring cup *100c* of the mold 100 and the outlet 10 of the ladle. The ladle holder 2' that is suspended and carried by the self-driven carriage 53 travels at a height $h_2$ with respect to the pouring cup *100c* of the mold, as indicated by full lines in FIG. 11. After the stoppage in the position B in the pouring section, the ladle holder 2' is lowered by the hoist 70 to the position indicated by imaginary lines, where the ladle outlet point 10' is at a height $h_1$ above the pouring cup *100c* of the mold on a truck 104 over the mold conveyor line.

The ladle 1 that has come down to the position of the imaginary lines is then rotated under control to a posture such that the molten metal surface in the ladle is slightly beneath the outlet 10. As an empty mold is driven to the point B, the ladle drive motor M starts and the ladle is tilted at a rotating velocity $V_{\theta 1}$. The molten metal L in the ladle begins to flow out of the outlet 10 and past the point X in the released streamline T (FIG. 3), and the outflow of the molten metal is detected, for example, by an infrared-ray-actuated molten-metal detector installed on the side plate 18 of the ladle holder 2'. Thereupon, the velocity at which the ladle 1 is rotated is quickly and continuously decreased to $V_{\theta 2}$ ($V_{\theta 2} < V_{\theta 1}$). As long as the ladle 1 is rotated at this constant velocity $V_{\theta 2}$, the molten metal is poured into the pouring cup *100c* while maintaining the substantially unchanged streamline T.

The amount of molten metal to be poured into each mold 100 is predetermined. The load weighing device 76 measures the amount being poured out of the ladle 1, and once the predetermined amount is reached, the ladle tilting drive and speed control mechanism will act to rotate the ladle 1 backward at a velocity $V_{\theta 3}$ so that the molten stream from the ladle outlet is cut off and the pouring is concluded. The ladle 1 is further rotated reversely until a preset angle is reached, where the ladle is kept stationary for the next pouring run. Although the pouring unit may continue the pouring at the point B until the ladle 1 is emptied, the following pouring procedure, for example, may be adopted instead for a higher casting efficiency. In the embodiment shown in FIG. 13, a given pouring unit concludes the pouring at the point B while the ladle 1 still contains more than four moldfuls of molten metal, and is moved to the point C at a velocity higher than that of the molds being driven by a tact system in the direction *x*. At the point C the pouring unit stops and prepares for the next pouring operation, and then one of empty molds arrives at C and pouring is started. While the pouring is in progress at the point C, another pouring unit with a ladleful of molten metal reaches the point B, prepares for and starts pouring. The pouring unit at the point C thus fills all of the empty molds, four in all in the embodiment under consideration, located at the points B and C, and then concludes the pouring and is moved back to one of the melting furnaces 106 and the associated holding furnace 107. Repetition of the afore-described procedure permits uninterrupted casting. The velocities $V_{\theta 1}$, $V_{\theta 2}$ and $V_{\theta 3}$ at which each ladle is tilted in swinging movement may be set to optimum values in consideration of such varying factors as the ladle capacity, viscosity of the molten metal due to its material and temperature, and the relationship ($l_1$, $H_1$) between the ladle outlet and the pouring cup of each mold.

Figure 14:
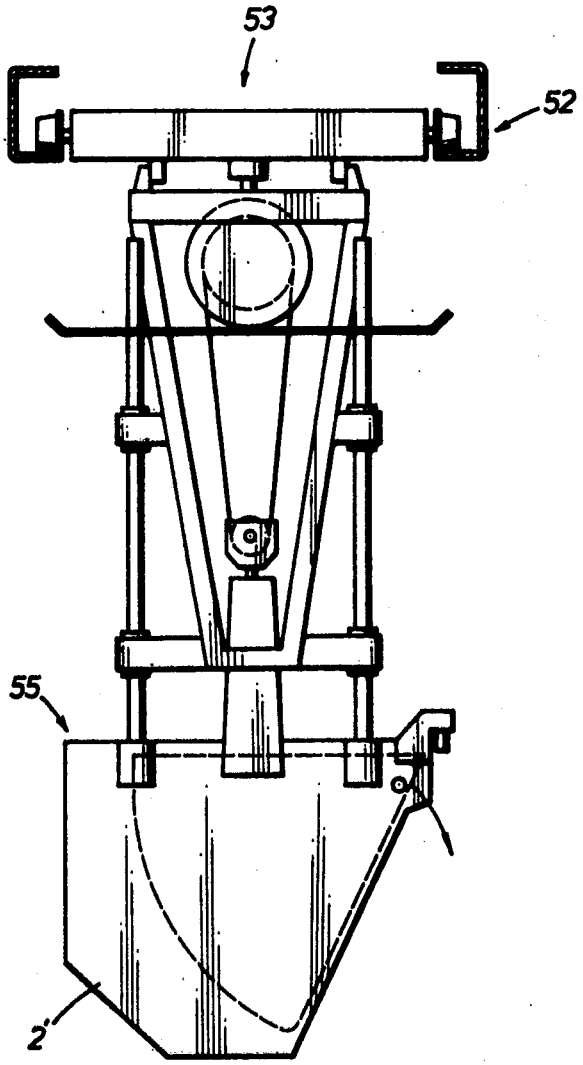
FIG. 14 is a schematic side view of another embodiment of the self-propelled pouring apparatus of the invention.

The present invention has thus far been described as embodied in a self-propelled pouring apparatus of a narrow-gauge monorail type which makes use of limited space to arrange a loop of track as desired in the usually promiscuous and labyrinthine foundry and achieve a maximum efficiency in pouring not only for continuous casting but also for the production of large castings with molds closely placed over the foundry floor. It is to be understood, however, that the pouring apparatus of the invention is adapted also for a broad-gauge monorail system as shown in FIG. 14 or a system using rails laid on the ground (not shown).

With the construction and functions described above, the self-propelled pouring apparatus in accordance with the invention may be used without major modification for both continuous casting and pouring into individual molds closely placed on a floor. Especially where it is incorporated in a monorail system which fully utilizes the foundry space tridimensionally, the pouring apparatus can make the most of the existing facilities on the ground. Tracks with small radii of curvature may be adopted. Moreover, the pouring apparatus of the invention may be used advantageously with a continuous casting plant which involves an intricate process for simultaneously producing several different kinds of castings used two or even three separate rows of molding machines. Further, the apparatus of the invention puts no special limitation to the relative positions of the pouring section and the melting furnace but permits them to be arranged freely as desired. For this reason the apparatus of the invention may be introduced into any of existing foundries. The pouring apparatus is simple in construction and easy to dismount. In case of a trouble, it can be easily inspected and maintained within a short downtime. An additional advantage is that, because the apparatus is small in size and available at low cost, foundrymen can afford a stand-by unit to ensure uninterrupted operation of their casting equipment.

While there has been described what is at present considered to be preferred embodiments of the invention, it will be understood that various modifications may be made therein, and it is intended to cover in the appended claims all such modifications that fall within the true spirit and scope of the invention.

I claim:

1. A method for pouring molten metal from a tiltable ladle into a mold; said ladle having a front wall, and a pouring outlet from which such molten metal is poured disposed in said front wall beneath the terminal edge thereof, said outlet having a bottom edge guide of arcuate sectional configuration for guiding the molten metal from the outlet in a constantly uniform stream into such mold; the extent of the arcuate shape of the molten metal guide being across the thickness of the front wall of the ladle such that the horizontal and vertical distances between the mold and the horizontal and vertical axes passing through the point at which the metal begins free fall remain substantially unchanged during all phases of pouring; the steps comprising tilting said tiltable ladle from a first position at a first velocity to a molten metal fall starting point at which molten metal begins to flow from said ladle outlet; continuing to tilt said ladle, without stopping, at a second velocity one-fortieth to one-one hundredth of said first velocity; said second tilting velocity being maintained constant; pouring a streamline of molten metal of consistent arcuate configuration between said ladle and mold while maintaining said second tilting velocity; said first velocity being reduced to said second velocity by means of a continuous deceleration within 0.5 second whereby undulation of the molten metal in said ladle is minimized; and tilting said ladle in the direction of said first position to terminate flow of molten metal from said ladle after a desired amount of such molten metal has been poured into such mold.

2. The method of claim 1 in which said ladle is tilted in the direction of said first position at a velocity at least as great as said second velocity.

3. A method for pouring molten metal from a tiltable ladle into a mold, the ladle comprising a front wall having a pouring outlet formed therein, such outlet having a molten-metal bottom edge guide of arcuate sectional configuration for guiding the molten metal from the outlet in a constantly uniform stream into such mold; the extent of the arcuate shape of the molten metal guide being across the thickness of the front wall of the ladle such that the horizontal and vertical distances between the mold and the horizontal and vertical axes passing through the point at which the metal begins free fall remain substantially unchanged during all phases of pouring; a vertical section of said ladle through the outlet having a segmental shape whereby the exposed area of molten metal in said ladle remains substantially constant during the pouring operation; said front wall having an arcuate bulge projecting into the ladle interior and extending from either side of said pouring outlet across the width of the inner surface of said front wall; said bulge having a radius of formation movable about the center of arc of the arcuately shaped molten-metal bottom edge guide; the axis of ladle rotation for tilting said ladle being coincident with said center of both of the aforementioned arcs; said method comprising tilting said ladle at a velocity $V_{\theta 1}$ into a pouring position; continuing the tilting of said ladle from said pouring position at a velocity $V_{\theta 2}$ during the pouring of the molten metal into said mold; said tilting velocity $V_{\theta 1}$ being approximately 40 to 100 times as great as the tilting velocity $V_{\theta 2}$ employed during pouring of the molten metal; the reduction from the pre-pouring tilting velocity $V_{\theta 1}$, to the pouring tilting velocity $V_{\theta 2}$ being effected continuously within a period of 0.5 second, whereby the pouring is carried out while maintaining the relative positions of the fall-starting point of the molten metal and the pouring cup of the mold constant so that the streamline of the falling molten metal between said ladle and said pouring cup of the mold remains unchanged.

4. The method for pouring of claim 3 in which the pouring tilting velocity $V_{\theta 2}$ is controlled so that the rate at which molten metal is poured from said ladle into said mold is substantially constant.

5. A ladle construction adapted to pour metal in a constant streamline; said ladle having a front wall; a pouring outlet formed in said front wall; a molten-metal guide bottom edge of arcuate shape in vertical section provided at the bottom of said pouring outlet to guide the molten metal from said outlet in a constantly uniform stream into an underlying mold; the extent of the arcuate shape of the molten metal guide being across the thickness of the front wall of the ladle such that the horizontal and vertical distances between the mold and the horizontal and vertical axes passing through the point at which the metal begins free fall remain substantially unchanged during all phases of pouring; the vertical sectional contour of said ladle as cut through said outlet being segmentally shaped to maintain the exposed surface area of molten metal in said ladle substantially constant during the pouring operation; said front wall being formed, on the inner surface portion except for the pouring outlet, with an arcuate bulge centered around the center of arc of the arcuately shaped molten-metal guide bottom edge; the axis of rotation of said ladle for tilting the same in swinging movement being an axis extending through the common center of arcs of said arcuate molten-metal guide bottom edge and said arcuate bulge.

6. A tiltable ladle adapted to pour molten metal in a uniform streamline at a constant rate comprising a front wall, a ladle bottom portion joined to said front wall at its lower end; said front wall defining a distal edge at the opposite end; a pouring outlet formed in the front wall having a molten-metal bottom edge guide of arcuate sectional configuration spaced from said front wall distal edge; the extent of the arcuate shape of the molten-metal guide being across the thickness of the front wall of the ladle such that the horizontal and vertical distances between the mold and the horizontal and vertical axes passing through the point at which the metal begins free fall remain substantially unchanged during all phases of pouring; said edge guide being adapted to guide molten metal from the ladle in a constantly uniform stream; the ladle including a rear wall attached to the distal end of the front wall such that a vertical section of said ladle passing through said pouring outlet and transversely to said rear wall defines a segmental shape in which the exposed surface area of molten metal in said ladle is maintained substantially constant in the normal course of ladle tiltable movement and pouring molten metal through said pouring outlet; transverse arcuate projections disposed on the inner surface of said front wall and extending across the width thereof from opposed edge portions of said pouring outlet; the radius of formation of said projections having the same axis of rotation as the radius of formation of said pouring outlet guide edge of arcuate configuration; said axis of rotation being also the axis of rotation for tilting said ladle when pouring molten metal through said pouring outlet.

7. The ladle of claim 6 in combination with means connected to said tiltable ladle for controlling the tilting velocity thereof, the control means comprising means engaging said ladle for measuring the weight of the ladle and generating a signal; comparator means associated with said weight measuring means for comparing the signal of a predetermined reference velocity with the signal generated by the ladle weight measuring means and for generating a signal resulting from such comparison; and means associated with the comparator means and ladle responsive to the signal from the comparator means.

8. The combination of claim 6 in combination with means connected to said tiltable ladle for controlling the tilting velocity thereof, the control means comprising means for determining the actual tilting velocity, a comparator for comparing a predetermined reference velocity with the actual tilting velocity determined, and for generating a signal; said means for controlling the tilting velocity being responsive to the signal from said comparator means.

9. The combination of claim 8 in which the signal responsive means for controlling the tilting velocity comprises magnetic powder clutches and a magnetic powder brake associated with said clutches.

10. The combination of claim 8 in which the signal responsive means for controlling the tilting velocity comprises a magnetic powder clutch.

11. A self-propelled pouring apparatus comprising: a track defining a path of travel in a casting line; a self-propelled carriage equipped with drives and controls and adapted to travel under control automatically along said track; a driven carriage separated from, and adapted to be driven by, said self-propelled carriage to run along said track; a chassis pivotally suspended from said self-propelled carriage and driven carriage via supporting pivots so as to couple the said two carriages; a tiltable ladle having a pouring outlet in a front wall thereof, a molten-metal guide bottom edge having an arcuate shape in vertical section provided at the bottom of said pouring outlet to guide the molten metal from said outlet in a constantly uniform stream into a mold; the extent of the arcuate shape of the molten metal guide being across the thickness of the front wall of the ladle such that the horizontal and vertical distances between the mold and the horizontal and vertical axes passing through the point at which the metal begins free fall remain substantially unchanged during all phases of pouring; the vertical section contour of said ladle as cut through said outlet being segmentally shaped to maintain the exposed surface area of molten metal in said ladle substantially constant during the pouring operation; said front wall being formed, on the inner surface portion, except for the pouring outlet, with an arcuate bulge centered around the center of arc of the arcuately shaped molten-metal guide bottom edge; the axis of rotation of said ladle for tilting the same in swinging movement being an axis extending through the common center of arcs of said arcuate molten-metal guide bottom edge and of said arcuate bulge; a hanger unit including means for supporting said ladle detachably and turnably about its axis of rotation and also including means for driving said ladle about its axis of rotation; a hoist securing said hanger unit to said chassis, and a load weighing device for measuring the amount of molten metal in said ladle; guide means coactive with said hanger unit as said unit is moved upward or downward by said hoist; and control means associated with the ladle for controlling the rate of pouring in response to measurement signals from said load weighing device.

* * * * *

UNITED STATES PATENT OFFICE

CERTIFICATE OF CORRECTION

PATENT NO. : 4,112,998

DATED : September 12, 1978

INVENTOR(S) : Jiro Sato

It is certified that error appears in the above-identified patent and that said Letters Patent are hereby corrected as shown below:

Column 3, line 51, change "securd" to -- secured --.

Column 5, line 59, delete "into" and insert -- the --.

Column 8, line 36, delete "or" and insert -- of --.

line 38, change "holer" to -- holder --.

Column 10, line 15, Change "emobodiment" to -- embodiment --.

Column 10, line 17, change "ldle" to -- ladle --.

Column 13, line 14, change "descreasing" to -- decreasing --.

Column 19, line 38, change "used" to -- using --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*